United States Patent [19]

Chupka

[11] Patent Number: 4,725,007

[45] Date of Patent: Feb. 16, 1988

[54] APPARATUS FOR PULPING HIGH CONSISTENCY PAPER MAKING STOCK

[75] Inventor: David E. Chupka, Middletown, Ohio

[73] Assignee: The Black Clawson Company, Middletown, Ohio

[21] Appl. No.: 816,696

[22] Filed: Jan. 6, 1986

Related U.S. Application Data

[63] Continuation of Ser. No. 682,588, Dec. 17, 1984, abandoned, which is a continuation of Ser. No. 470,847, Feb. 28, 1983, abandoned.

[51] Int. Cl.[4] ..... B02C 13/18

[52] U.S. Cl. ..... 241/46.02; 162/261; 241/46.17

[58] Field of Search ..... 162/261; 241/46.02, 241/39, 46.11, 46.17

[56] References Cited

U.S. PATENT DOCUMENTS

| | | | |
|---|---|---|---|
| 2,641,971 | 6/1953 | Ellis | 241/39 |
| 3,035,781 | 5/1962 | Wallen | 241/46.17 |
| 3,145,936 | 8/1964 | Monks | 241/46.17 |
| 3,547,357 | 10/1968 | Johnson | 241/46.17 |
| 3,889,885 | 6/1975 | Couture | 241/46.17 |
| 4,109,872 | 8/1978 | Couture | 241/46.11 |
| 4,413,789 | 11/1983 | Reinecker et al. | 241/46.17 |
| 4,535,943 | 8/1985 | Couture | 162/261 |
| 4,538,765 | 9/1985 | Mayr et al. | 162/261 |
| 4,593,861 | 6/1986 | Blakley et al. | 241/46.17 |

*Primary Examiner*—Steve Alvo

*Attorney, Agent, or Firm*—Biebel, French & Nauman

[57] ABSTRACT

An apparatus for pulping paper making stock at high consistencies which includes a rotor body having a plurality of vanes extending generally radially outwardly therefrom and a feed screw mounted centrally of the rotor body and extending upwardly therefrom along an axis of rotation of the rotor body. The feed screw includes a conical body having a base with a periphery adjacent root portions of the rotor vanes and at least one helical flight extending along the length of the conical body and, in one embodiment, has a tapered end which is located adjacent a vane root. The rotor body and feed screw are mounted for rotation in a center portion of the bottom wall of a tub for holding paper making stock such that, when the rotor is rotated, the conical body and helical screw guide material contacting the feed screw downwardly and outwardly to contact the rotor vanes which impel the stock toward the side wall of the tub with sufficient force to climb the wall.

2 Claims, 5 Drawing Figures

APPARATUS FOR PULPING HIGH CONSISTENCY PAPER MAKING STOCK

This application is a continuation of application Ser. No. 682,588, filed Dec. 17, 1984 and now abandoned, which is a continuation of application Ser. No. 470,847, filed Feb. 28, 1983 and now abandoned.

BACKGROUND OF THE INVENTION

This invention relates to apparatus for pulping paper making stock at relatively high consistencies, and more particularly to paper pulping apparatus in which a vaned rotor is utilized to circulate the stock within a tub.

Paper pulping apparatus typically includes a tub having a bottom wall and a cylindrical side wall extending upwardly therefrom, a vaned rotor centrally mounted on the bottom wall for rotation within the tub, and a screen or valve means located in or near the bottom wall to provide means for removal of the pulped paper stock. The rotor vanes include leading faces which are shaped and sized to contact stock near the bottom wall of the tub and propel it radially outwardly from the rotor against the side wall, which directs the stock upwardly. The rising stock flows to the center of the tub and then downwardly toward the rotating vanes. Thus during a pulping operation, the stock is caused to flow in a generally circular pattern, and the reduction in size of the individual particles of paper stock is due largely if not exclusively to the high sheer forces between particles of stock created by this flow pattern.

Many pulping devices of this construction presently in use are limited in application to paper making stock having a relatively low consistency, typically in the range of 4–7% solids content. If the consistency of the stock is raised appreciably above about 7%, the density and viscosity of the stock is such that it does not easily flow downwardly between the spinning vanes of the rotor. The vanes will displace an initial quantity of pulp outwardly, but cavitation will then occur since the displaced pulp is not replaced by downwardly flowing pulp.

In order to perform a pulping process upon stock having a consistency in excess of about 10%, special rotors have been developed. For example, in the Blakely et al. U.S. patent application Ser. No. 407,371, filed Aug. 12, 1982 and commonly assigned, a high consistency pulping apparatus is disclosed having a rotor with a vertically oriented and axially aligned feeding screw. The rotor includes vanes in the form of circumferentially-extending members with a half-crescent shape which are disposed about the periphery of a disk-shaped plate. The feeding screw is mounted in the center of the plate and includes a cylindrically-shaped body having a base which is spaced from the rotor vanes, and a helical screw flight which extends along the body and terminates at a squared end above the disk-shaped plate supporting the vanes.

When rotated in a tub containing stock at 12–13% consistency, the feeding screw guides the stock downwardly to the region of the rotor vanes which then propel it outwardly against the walls of the tub. The higher consistency stock climbs the walls of the tub, and baffles are employed to direct the pulp downwardly toward the tub center.

The potential advantages of high consistency pulping devices have been well recognized. For example, since the density of the stock is considerably higher for pulp stock having a consistency of about 14% than for stock having a consistency of about 7%, the shear stresses created during a high consistency pulping operation are significantly greater, so that the time required to perform a pulping operation with high consistency stock may be the same or even less than the time required for pulping the same volume of low consistency stock in the same pulping tub.

However, there often exist inherent disadvantages with high consistency pulping devices of the type previously described. For example, since the helical screw flight of the feeding screw terminates above the base of the rotor and is spaced from the rotor vanes, there may exist a tendency for the high density stock to collect and form a wedge between the underside of the trailing portion of the screw flight and the portion of the rotor base immediately beneath it. Another disadvantage is that there does not exist means to guide the stock from the squared trailing portion of the screw flight to the working faces of the vanes, so that voids may be created surrounding the working faces of the vanes.

Accordingly, there is a need for a high consistency pulping apparatus having a rotor which minimizes the likelihood of cavitation. There is also a need for a high consistency pulping apparatus in which the rotor provides means for guiding the high density stock in a smooth and uninterrupted path from a location adjacent the center of the rotor to the working faces of the vanes without the stock becoming wedged between the screw flight and rotor vane.

SUMMARY OF THE INVENTION

The present invention provides an apparatus for pulping paper making stock which is capable of pulping relatively high consistency stock, that is, stock in a range of approximately 10–25% solids, in a manner that creates the necessary circular flow patterns to generate the high shear forces between paper particles in order to perform the pulping operation in a minimum amount of time. Another advantage of the invention is that it includes a rotor that is designed to minimize the likelihood of cavitation and the likelihood of stock collecting on the rotor to obstruct the downward and outward flow of stock to the vanes.

The present invention includes a tub having a bottom wall and a cylindrical side wall extending upwardly therefrom, a rotor body mounted for rotation in a vertical axis in the center of the bottom wall, a plurality of vanes extending generally radially outwardly from the rotor body at root portions thereof, and a feed screw mounted centrally of the rotor body and extending upwardly therefrom.

The feed screw has a conical body and at least one helical flight extending along the body such that, when the rotor is rotated in the presence of high consistency stock, the flight and conical body cooperate to guide stock contacting the feed screw downwardly and outwardly toward the faces of the vanes. This downward and outward movement of the pulp resulting from the rotation of the feed screw causes the pulp to flow directly to the faces of the vanes and reduces the likelihood of the stock collecting on the rotor between the feed screw and vanes. Furthermore, this flow path ensures that stock flows downwardly between vanes so that the entire face of each vane can provide the maximum pumping action for which it was designed.

In a preferred embodiment, the conical body of the feed screw includes a base sized such that its periphery is adjacent the root portions of the rotor vanes. The trailing end of the screw flight blends into the working face of a vane to form a continuous surface therewith. In another embodiment, the flight of the feed screw includes a trailing edge which tapers in width and terminates at the periphery of the base adjacent a vane root. Thus, the combination of the feed screw with the rotor provides a guiding surface along which the stock may travel which extends from the upper tip of the feed screw to the outer tip of the rotor vane.

Preferably, the feed screw is sized such that, when mounted to the rotor body, its height above the bottom wall of the pulping tub approximates the intended depth of the stock within the tub. When rotated, the rotor of the preferred embodiment causes the stock within the tub to flow in the previously described circular pattern such that the level of the stock at the center of the tub is below the level of the stock at the side wall, thereby exposing the tip of the feed screw. When the feed screw and stock are in this configuration, the feed screw provides a means of escape for any air which is present in the vicinity of the vanes, thus further reducing the likelihood of cavitation. As shown in FIG. 3, these results may be obtained with the height of the feed screw approximately equal to the maximum diameter of the rotor.

Another advantage of the construction of the present invention over prior art high consistency pulping devices is that the invention can utilize prior art rotors which previously were capable of functioning only in low consistency pulping operations. By sizing the feed screw such that the periphery of the base and trailing portion of the flight are substantially contiguous with the faces of the vanes, the feed screw can be retrofitted to a prior art rotor, such as the rotor disclosed in the Couture U.S. Pat. No. 3,889,885. However, due to the nature of high consistency paper making stock, it is preferable although not necessary to utilize a rotor having between three and six vanes, since it is difficult to cause high consistency pulp to flow between the relatively narrow spaces existing between the vanes of rotors having more than six vanes. In rotors having more than three or four vanes, it is also preferable to utilize a feed screw having multiple flights so that the stock can be urged downwardly and outwardly in a relatively balanced pattern about the periphery of the rotor.

Accordingly, it is an object of the present invention to provide an apparatus for pulping paper making stock at high consistencies which minimizes the likelihood of cavitation; an apparatus which provides a continuous path along which stock may travel from an upper portion of the pulping tub to the outer tip of the vane; and an apparatus for pulping high consistency stock which can be made by modifying low consistency systems.

Other objects and advantages of the present invention will become apparent from the following description, the accompanying drawings and the appended claims.

DESCRIPTION OF THE PREFERRED EMBODIMENTS

Figure 1:
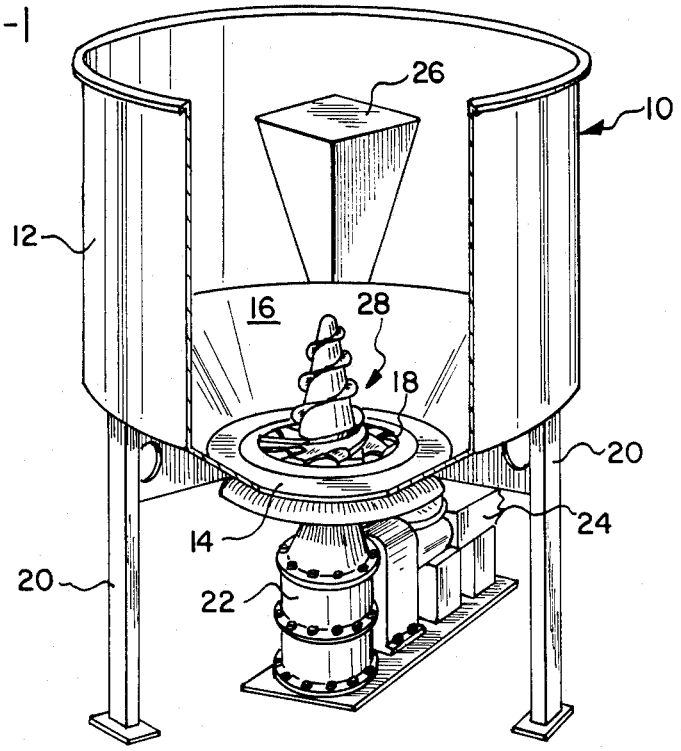
FIG. 1 is a perspective view of the pulping apparatus of the preferred embodiment of the invention in which the tub wall has been cut away to show the rotor.
Figure 2:
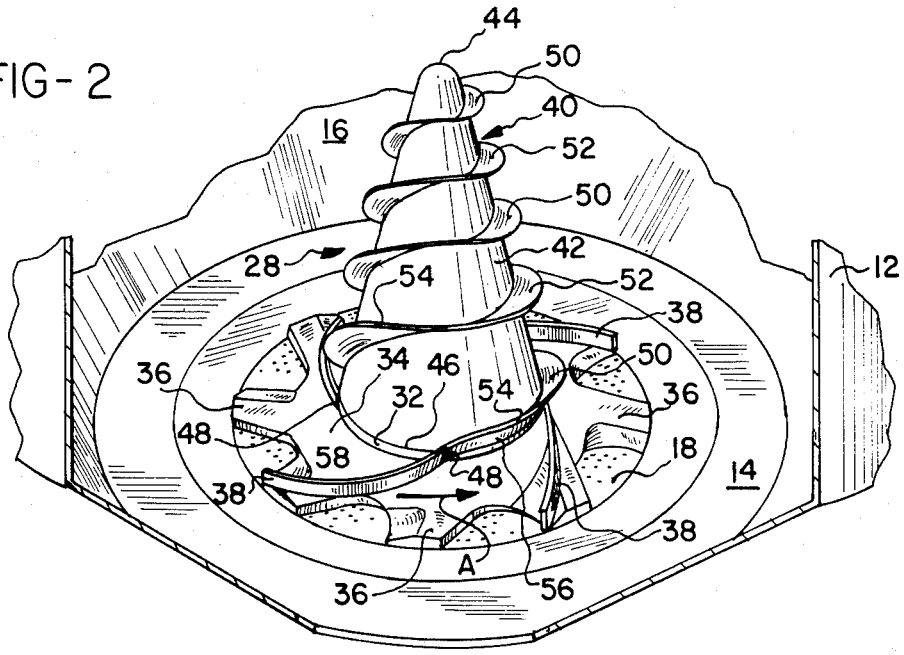
FIG. 2 is a detail of the rotor of FIG. 1.

The pulper shown in FIG. 1 includes a tub 10 having a cylindrical upper wall 12 and a bottom wall comprising a plane center section 14 surrounded by a frustoconical portion 16. As shown in FIG. 2, the center section 14 includes a perforated bed plate 18 for draining the pulped paper stock from the tub 10 after the completion of the pulping operation. The tub 10 is mounted on supports 20 above a gear drive 22 which is directly driven by a motor 24. The cylindrical side wall 12 includes baffles 26 which direct pulp stock flowing upwardly against the wall outwardly toward the center of the tub 10.

A rotor, generally designated 28, is mounted in the center of the perforated bed plate 18 and is driven by the motor 24 and gear drive 22. The rotor 28 includes a rotor body 30 having a cover plate 32 and vane ring 34. The vane ring 34 supports a plurality of pulping vanes 36 which extend generally radially outwardly from the rotor body in circumferentially spaced relation with each other and overhanging relation with the bottom wall 14. Alternate vanes 36 are provided on top with a pumping vane 38, and as shown in the drawings, the maximum radius of the rotor, to the tip of each vane 36, so closely approaches the radius of the bottom wall 14 that the rotor effectively covers the major portion of the wall 14.

The rotor 28 as described thus far is of a type well-known in the art and is commonly used in pulping devices for defibering stock at between 5% and 8% consistency. The structure and cooperation of the rotor 28 with the perforated bed plate 18 are described more fully in the Couture U.S. Pat. No. 3,889,885, commonly assigned, the disclosure of which is incorporated herein by reference.

However, the rotor 28 of the present invention differs significantly from prior art rotors in that it includes a feed screw, generally designated 40. The feed screw 40 includes a conical body 42 which is concentric with the rotor body 30, and extends upwardly therefrom. The rotor 28 may be cast as a single unit, or the feed screw 40 and rotor body 30 may be fabricated separately and then joined together. The conical body 42 includes a rounded top 44 and a circular base 46 which extends to the root portions 48 of the pumping vanes 38 and the overall height of the feed screw 40 is shown in FIG. 3 as approximately equal to the maximum diameter, or twice the maximum radius, of the rotor vanes.

The feed screw 40 includes helical screw flights 50,52 which intertwine along the length of the conical body 42. Each of the screw flights 50,52 is ribbon-shaped and includes a trailing portion 54 which terminates at the base 46 of the conical body 42 adjacent the root 48 of a vane 38. In the embodiment shown in FIGS. 1 and 2, the trailing portions 54 are twisted so that their undersides 56 are contiguous with the face 58 of the pumping vane 38 so as to form a continuous surface therewith.

Figure 3:
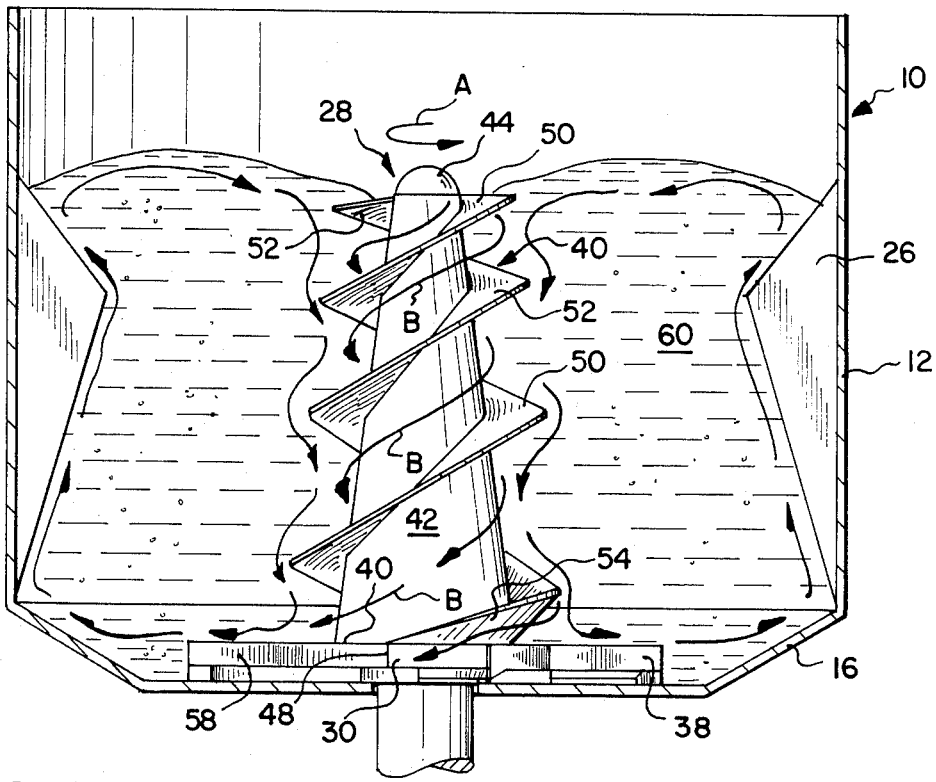
FIG. 3 is a side elevation in section of the tub of FIG. 1 showing the flow pattern of pulp stock during a pulping operation.

The operation of the pulping apparatus is best shown in FIG. 3. Prior to operation, the tub 10 is filled with paper making stock 60 which preferably is at a consistency of between 12% and 25% solids. The level of the stock within the tub 10 should approximate the height of the rounded top 44 of the feed screw 40 above the center section 14. Once the tub 10 is filled, the rotor 28 is rotated in a counterclockwise direction, indicated by arrows A shown in FIGS. 2 and 3. When the rotational speed of the rotor 28 has reached its intended operational speed, the helical screw flights 50,52 of the feed screw 40 draw the stock 60 downwardly toward the rotor body 30. At the same time, the stock is urged outwardly by the increasing diameter of the conical body 42. Thus, the stock travels in a downward helical path of increasing diameter, as indicated by arrows B in FIG. 3.

Since the base 46 of the helical body 42 and the trailing portions 54 of the screw flights are located adjacent the roots 48 of the vanes 38, the stock 60 is guided directly to the faces 58 of the pumping vanes 38. The downward and outward motion imparted to the stock 60 by the cooperation of the conical body 42 and flights 50,52 places the stock down between the vanes 36 and 38 so that it contacts the entire area of the vane face 58. Thus, the efficiency of the vanes 38 is increased since almost the entire vane face 58 contacts the pulp 60.

Once the pulp has contacted the vanes 38, it is propelled outwardly in a generally radial direction toward the frusto-conical portion 16, and then upwardly against the wall 12 to the top of the tub 10. The rising pulp encounters the baffles 26 which act to direct the pulp downwardly and inwardly toward the center of the tub where it again is directed toward the rotor body 30 by the feed screw 40. Due to the high consistency of the stock 60, the depth of the upwardly rising stock at the periphery of the tub 10 is greater than that at the tub center. Therefore, during operation, the rounded top 44 becomes exposed, and the feed screw provides a channel or conduit for the escape of air from the vicinity of the rotor body 30, thereby further reducing the likelihood of cavitation. It is to be understood that the apparatus can be operated such that the depth of stock in the tub may exceed the height of the top 44, in which case the feed screw 40 will convey air to the upper level of the stock, where it will escape through the remaining stock to the atmosphere.

With the embodiment shown in FIGS. 1, 2 and 3, the conical body 42, the flights 50,52 and the vane faces 58 combine to provide a substantially continuous pathway which positively guides the stock from the top of the feed screw 40 to the outer tips of the rotor vane faces 58. Since the trailing portions 54 of the screw flights blend into the vane faces 48, there are no pockets or gaps which may collect pulp or form voids, so that the generated flow of pulp is much smoother than with prior art rotors having feed screws whose flights are not contiguous with the vane roots 48.

Figure 4:
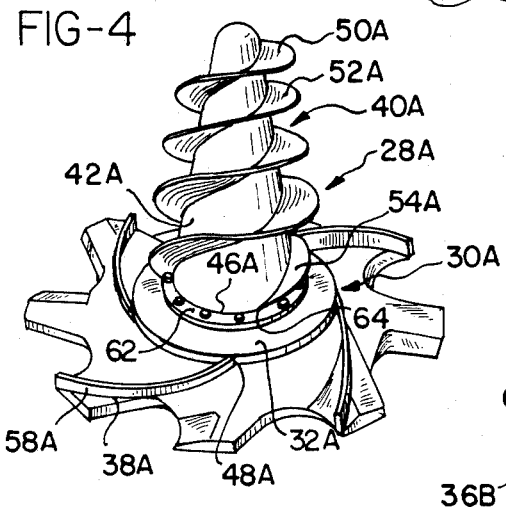
FIG. 4 is an alternate embodiment of the rotor of the invention.

One of the advantages of the present invention is that a previously existing low consistency pulping apparatus may be converted to perform the highly efficient high consistency pulping operation of the present invention with a minimum of expense. For example, the rotor 28A shown in FIG. 4 includes a rotor body 30A in which a feed screw 40A has been attached to the cover plate 32A by a bolted flange 62 which extends outwardly from the periphery base 46A of the conical body 42A. The design of the rotor 28A differs from the rotor 28 shown in FIGS. 1–3 in that the periphery of the base 46A is not immediately adjacent the vane roots 48A of the pumping vanes 38A. Furthermore, the trailing portions 54A of the screw flights 50A,52A are not contiguous with the vane roots 48A. Rather, the trailing portions 54A taper in width until they terminate at a point 64 located at the base 46A of the conical body 42A.

Since the feed screw 40A cannot be fabricated easily such that its trailing portions 54A blend into the vane faces 58A of the pre-existing rotor 28A, it is desirable to taper the width of the trailing portions to a point 64 to reduce the likelihood that pulp stock will become wedged in the space between the underside of the trailing portions and the cover plate 32A or other portions of the rotor body 30A. Despite the fact that the conical body 42A and screw flights 50A,52A are not immediately adjacent the vane roots 48A, the feed screw 40A will still impart a downward and outward motion to the pulp stock within a tub which directs it to the faces 58A of the vanes 38A. This motion minimizes the likelihood that pulp stock will collect or stagnate in the central area of the rotor body 30A and not flow to the pumping vanes 38A.

Figure 5:
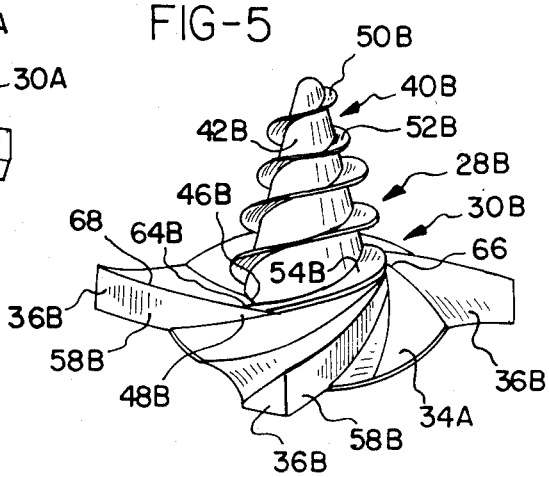
FIG. 5 is another embodiment of a rotor of the invention.

Another application of the invention is shown in FIG. 5 in which a rotor 28B includes a rotor body 30B having four vanes 36B, each of which includes a pumping face 58B. The vanes 36B are mounted on a generally frustoconical shaped vane ring 34B. Rotor bodies 30B of this type are generally used in pulping operations where the consistency of the pulp stock is between 5% and 8% solids.

A feed screw 40B is mounted to the central portion of the rotor body 30B and includes screw flights 50B,52B which intertwine about the conical body 42B and terminate immediately adjacent the vane roots 48B. Each of the trailing portions 54B of the screw flights 50B,52B taper in width in a manner similar to that of the embodiment of FIG. 4 and terminate at a point 64B on the base 46B of the conical body 42B.

Since the base 46B and points 64B are located immediately adjacent the vane roots 48B, the outer edges 66 of the trailing portions 54B combine with the upper edges 68 of the pumping faces 58B to form continuous edges therewith. Again, while the trailing portions 54B of the screw flights 50B,52B do not blend into the pumping faces 58B, the location of the trailing portions and the base 46B of the conical body 42B combine to provide a continuous path for the paper stock which guides the stock directly to the pumping faces 58B of the vanes 36B.

While the forms of apparatus herein described constitute preferred embodiments of the invention, it is to be understood that the invention is not limited to these precise forms of apparatus, and that changes may be made therein without departing from the scope of the invention.

What is claimed is:

1. Apparatus for pulping paper making stock at high consistencies in the range of 10–25% solids, comprising:

(a) a pulper tub having a bottom wall, an annular perforated bed plate forming a portion of said bottom wall, a cylindrical side wall and a frustoconical wall extending upwardly from said bottom wall to said side wall, (b) a rotor body of a smaller outer diameter than said bed plate mounted for rotation on a vertical axis in the center of said bottom wall, (c) pulping vanes extending generally radially outwardly from and beyond said rotor body in overhanging relation with said bed plate and in circumferentially spaced relation with each other to provide spaces therebetween exposing portions of said bed plate, (d) said rotor body also including pumping vanes above said pulping vanes, (e) means for rotating said rotor at sufficient velocity to cause said pulping vanes to impel high consistency pulp stock outwardly therefrom toward said frustoconical wall with sufficient force to climb said wall, (f) a feed screw mounted centrally of said rotor body and extending upwardly therefrom, (g) said feed screw having a conical body and helical flight means extending along said body, (h) said conical screw body including a base so proportioned as to cover a substantial portion of the center of said rotor body and having the periphery thereof adjacent the root portions of said pumping vanes whereby when said rotor is rotated, said flight means and said conical body cooperate to urge the stock downwardly and outwardly directly through the spaces between said pumping vanes to said exposed portions of said bed plate, (i) said pumping vanes including substantially vertically extending leading faces, (j) said flight means including flat undersides, and (k) a trailing portion of each said flight means being contiguous with one of said pumping vane faces such that said undersides and said faces form substantially continuous guide surfaces wherein higher consistency stock urged downwardly and outwardly by said screw is guided to said pulping vanes along said guide surface means.

2. A rotor assembly as defined in claim 1 wherein said feed screw body is substantially equal in height to twice the maximum radius of said vanes.

* * * * *